US007387740B2

(12) United States Patent
Lai

(10) Patent No.: US 7,387,740 B2
(45) Date of Patent: Jun. 17, 2008

(54) METHOD OF MANUFACTURING METAL COVER WITH BLIND HOLES THEREIN

(75) Inventor: Wen-Te Lai, Tu-cheng (TW)

(73) Assignee: Sutech Trading Limited, Tortola (VG)

( * ) Notice: Subject to any disclaimer, the term of this patent is extended or adjusted under 35 U.S.C. 154(b) by 0 days.

(21) Appl. No.: 11/268,950

(22) Filed: Nov. 7, 2005

(65) Prior Publication Data

US 2006/0049141 A1 Mar. 9, 2006

Related U.S. Application Data

(63) Continuation-in-part of application No. 10/346,966, filed on Jan. 17, 2003, now abandoned.

(51) Int. Cl.
*B44C 1/22* (2006.01)
*C25B 15/00* (2006.01)

(52) U.S. Cl. ..... 216/17; 216/32; 216/56; 216/100; 205/199; 219/121.68; 219/121.69; 204/485; 204/499; 29/849; 29/855; 29/856; 29/859

(58) Field of Classification Search ..... 216/17, 216/32, 56, 100; 205/199; 219/121.68, 219/121.69; 204/485, 499; 29/849, 855, 29/856, 859
See application file for complete search history.

(56) References Cited

U.S. PATENT DOCUMENTS 4,725,511 A * 2/1988 Reber ..... 428/620
4,904,360 A * 2/1990 Wilson et al. ..... 204/501
5,062,928 A * 11/1991 Smith ..... 205/135
5,225,265 A * 7/1993 Prandy et al. ..... 428/138
5,268,256 A * 12/1993 Goetz et al. ..... 430/284.1
5,650,249 A * 7/1997 Dull et al. ..... 430/5
2002/0066593 A1* 6/2002 Burdon et al. ..... 174/261
2002/0090578 A1* 7/2002 Schaefera et al. ..... 430/320
2002/0110752 A1* 8/2002 Heerman et al. ..... 430/311
2002/0142577 A1* 10/2002 Chung et al. ..... 438/623
2002/0195053 A1* 12/2002 Mey et al. ..... 118/623
2003/0186474 A1* 10/2003 Haluzak et al. ..... 438/21
2004/0094426 A1* 5/2004 Lai ..... 205/199

FOREIGN PATENT DOCUMENTS

JP 08-227868 A * 9/1996

* cited by examiner

*Primary Examiner*—Shamim Ahmed
(74) *Attorney, Agent, or Firm*—Wei Te Chung

(57) ABSTRACT

An exemplary method of manufacturing a metal cover (1) with blind holes (3) therein includes: step (60), preparing a metal substrate; step (62), covering the metal substrate with a protective film formed by electrophoretic deposition; step (64), forming holes in the protective film according to an intended pattern of the blind holes in the metal cover, thus exposing the metal surface through the holes; step (66), etching the metal substrate in the exposed areas to form the blind holes; and step (68), removing a remainder of the protective film from the metal substrate, thereby obtaining the finished metal cover. The method involving etching is relatively low-cost. Additionally, because electrophoretic deposition is used to cover the metal substrate with the protective film, the protective film can be formed on all surfaces of the metal substrate. Thus the method is especially advantageous for manufacturing a metal cover having a three-dimensional shape.

20 Claims, 3 Drawing Sheets

METHOD OF MANUFACTURING METAL COVER WITH BLIND HOLES THEREIN

CROSS-REFERENCE TO RELATED APPLICATIONS

This application is a continuation-in-part application of U.S. Ser. No. 10/346,966, filed Jan. 17, 2003, now abandoned.

FIELD OF THE INVENTION

The present invention relates to a method of manufacturing a perforated metal cover, and particularly to a method of manufacturing a metal cover with blind holes therein.

BACKGROUND OF THE INVENTION

A conventional method to form blind holes in a solid surface, as described in U.S. Pat. No. 5,143,578, uses a laser engraving process. The method disclosed uses a pulsed laser beam impinging on a solid surface to engrave a series of consecutive cells in the surface. The pulses of the laser beam are delivered in a series of consecutive groups each having two or more consecutive pulses. Each of said groups of pulses forms an individual cell in the solid surface. However, it is difficult to form deeper blind holes on a metallic surface using the laser engraving process. Additionally, the laser engraving method is relatively expensive, and consumes large amounts of energy to engrave blind holes in a metal surface.

Therefore, an improved method for manufacturing a metal cover with blind holes therein is desired to overcome the disadvantages of the prior art.

SUMMARY

A main object of the present invention is to provide a relatively low-cost method of manufacturing a metal cover with blind holes therein.

Another object of the present invention is to provide a method of manufacturing a three-dimensional metal cover with blind holes therein, which leaves the cover with a brilliant appearance and a high luster.

An exemplary method of manufacturing a metal cover with blind holes therein includes the steps of: preparing a metal substrate; covering the metal substrate with a protective film formed by electrophoretic coating; forming holes in the protective film according to a desired pattern of the blind holes on the metal cover, thus exposing the metal surface through the holes; etching the metal substrate in the exposed areas to form blind holes; and removing the protective film from the metal substrate to obtain the finished metal cover.

Other objects, advantages and novel features of the exemplary method and the invention will become more apparent from the following detailed description of preferred embodiments thereof when taken in conjunction with the accompanying drawings, wherein:

DETAILED DESCRIPTION OF THE PREFERRED EMBODIMENTS

Figure 1:
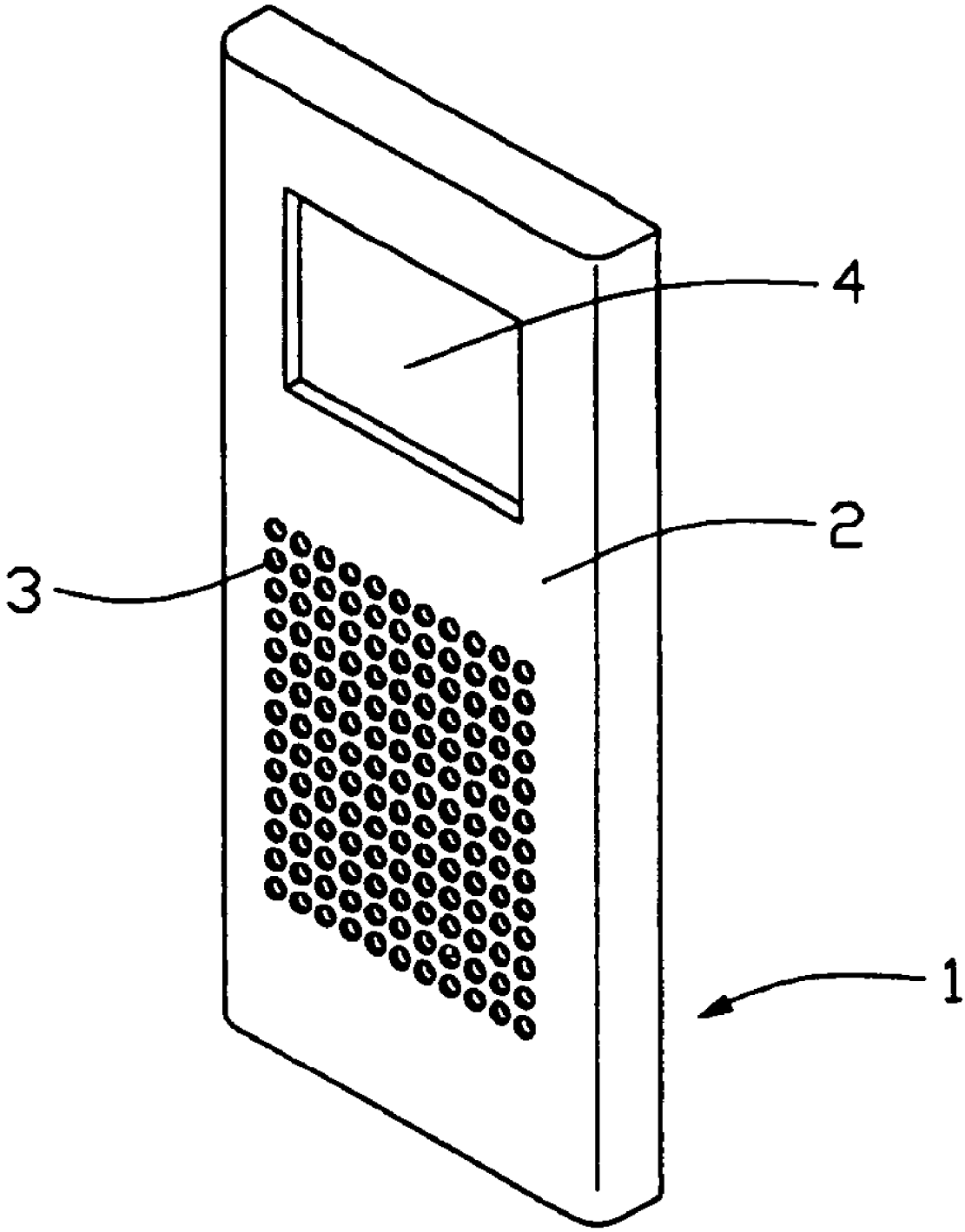
FIG. 1 is an isometric view of a metal cover with blind holes therein manufactured according to a method of the present invention.

Referring now to the drawings in detail, FIG. 1 shows a metal cover 1. The metal cover 1 includes a metal shell 2, with a plurality of blind holes 3 being formed in the metal shell 2 in a geometric pattern. A window 4 is defined in the metal shell 2 above the blind holes 3. In a preferred embodiment of the present invention, the metal cover 1 is made of aluminum.

Figure 2:
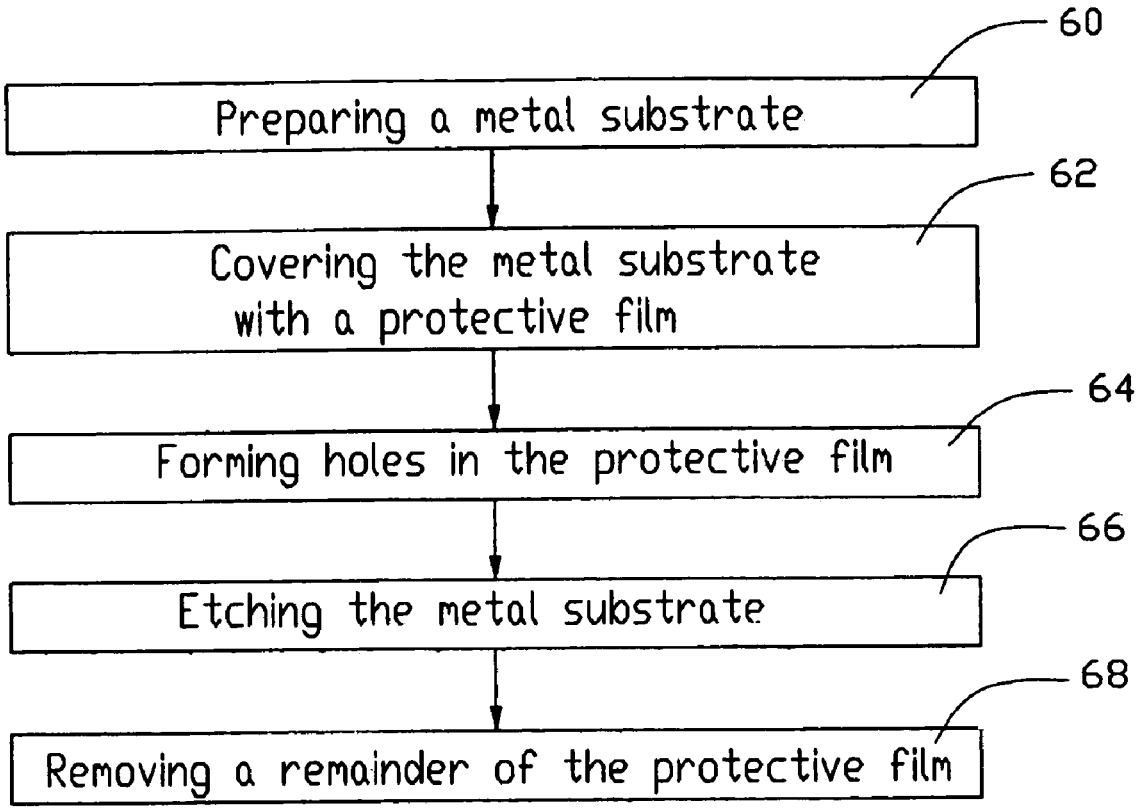
FIG. 2 is a flow chart of a first preferred method of manufacturing the metal cover of FIG. 1 according to the present invention.

FIG. 2 shows a first preferred method of manufacturing the metal cover 1. The method includes the steps of: step 60, preparing a metal substrate; step 62, covering the metal substrate with a protective film formed by electrophoretic coating; step 64, forming holes in the protective film on the metal substrate to expose areas of the metal substrate; step 66, etching the metal substrate at the exposed areas thereof; and step 68, removing a remainder of the protective film from the metal substrate, thus obtaining the finished metal cover 1.

In an exemplary embodiment, in step 60, firstly, a piece of aluminum sheet is cut into a plurality of aluminum substrates about the size of the metal cover 1. Secondly, the aluminum substrates are stamped into three-dimensional shapes, at the same time forming the openings 4 according to use requirements. After being stamped, the aluminum substrates have burrs on them and the edges of the aluminum substrates are rough, so it is necessary and important to grind the aluminum substrates. The grinding process can be performed in a vibratory finishing machine, in which ceramic grindstones are used as a finishing medium; and detergent and brightener are added and mixed for the grinding process. The grinding process is carried out for a predetermined time, until the aluminum substrates exhibit smooth and brilliant surfaces. Other grinding processes can also be used in place of the above process to grind the aluminum substrates. Then, the aluminum substrates are pretreated, which can include mechanical polishing, degreasing, chemical polishing, washing, and drying.

In step 62, each pretreated aluminum substrate is covered with a protective film formed by electrophoretic deposition. Preferably, the protective film is a cathodic electrophoretic coating formed by cathodic electrophoretic deposition. To form the cathodic electrophoretic coating, the aluminum substrate is dipped into a cathodic electrophoretic deposition bath containing amino epoxy resin, and direct current power is applied to the cathodic electrophoretic deposition bath. A concentration of the amino epoxy resin in the cathodic electrophoretic deposition bath is in the range from 10 percent to 20 percent by weight, and a voltage of the direct current power applied to the cathodic electrophoretic deposition bath is between 50 V and 80 V. The cathodic electrophoretic deposition is carried out for 40 to 80 minutes, until a cathodic electrophoretic deposition coating is formed on a surface of the aluminum substrate. Then the aluminum substrate is taken out of the cathodic electrophoretic deposition bath, and is dried for about 10 to 15 minutes at a temperature between 175 and 185 degrees Centigrade. A thickness of the cathodic electrophoretic coating is in the range from 6 μm to 10 μm. The cathodic electrophoretic coating must protect portions of the aluminum substrate covered by it from being etched. In this exemplary embodiment, the amino epoxy resin is EED-060 resin.

In step 64, through holes are formed in the protective film according to a desired pattern of the blind holes 3 in the finished metal cover 1, thus leaving a remainder of the protective film on the aluminum substrate. The through holes expose the aluminum substrate beneath the protective film, and can be formed using a laser engraving process. To perform the laser engraving, a pattern procedure is first programmed in a computer, to control a laser to engrave the through holes in the protective film according to the pattern of blind holes 3 desired. The aluminum substrate is then fixed in a laser machine, and a laser beam is directed onto the protective film covering the aluminum substrate. The engraving process is controlled by the pattern procedure, and substantially burns off the protective film over the areas of the aluminum substrate where the blind holes 3 will be formed. Thus a plurality of through holes arranged in the desired pattern is formed in the protective film, exposing the aluminum substrate in areas where the blind holes 3 are to be formed. Other laser engraving processes can be used in place of the above-described laser engraving process. Machining methods, such as drilling, can also be used to form the through holes in the protective film.

In step 66, the aluminum substrate is dipped into an etching tank containing an etching solution, so that the blind holes 3 are etched in the aluminum substrate where the through holes expose the surface of the aluminum substrate. The etching solution can be an alkali solution, such as a sodium hydroxide solution. When using a sodium hydroxide solution as an etching solution, a concentration of the free sodium hydroxide should be in the range from 10 g/L to 100 g/L. Other chemical additives can be added to the solution to stabilize the etching process. The etching process is carried out for a predetermined time at a temperature in the range from 30 to 90 degrees Centigrade until the blind holes 3 are formed to a desired depth. The etching solution can instead be an acid solution, such as a hydrochloric acid solution, a hydrofluoric acid solution, or a nitric acid solution. Alternatively, a conventional electrochemical etching process can be used.

In step 68, a solvent, such as methylbenzene, is used to wash the aluminum substrate, thereby removing the reminder of the protective film from the aluminum substrate. The finished metal cover 1 as shown in FIG. 1 is thus obtained.

Figure 3:
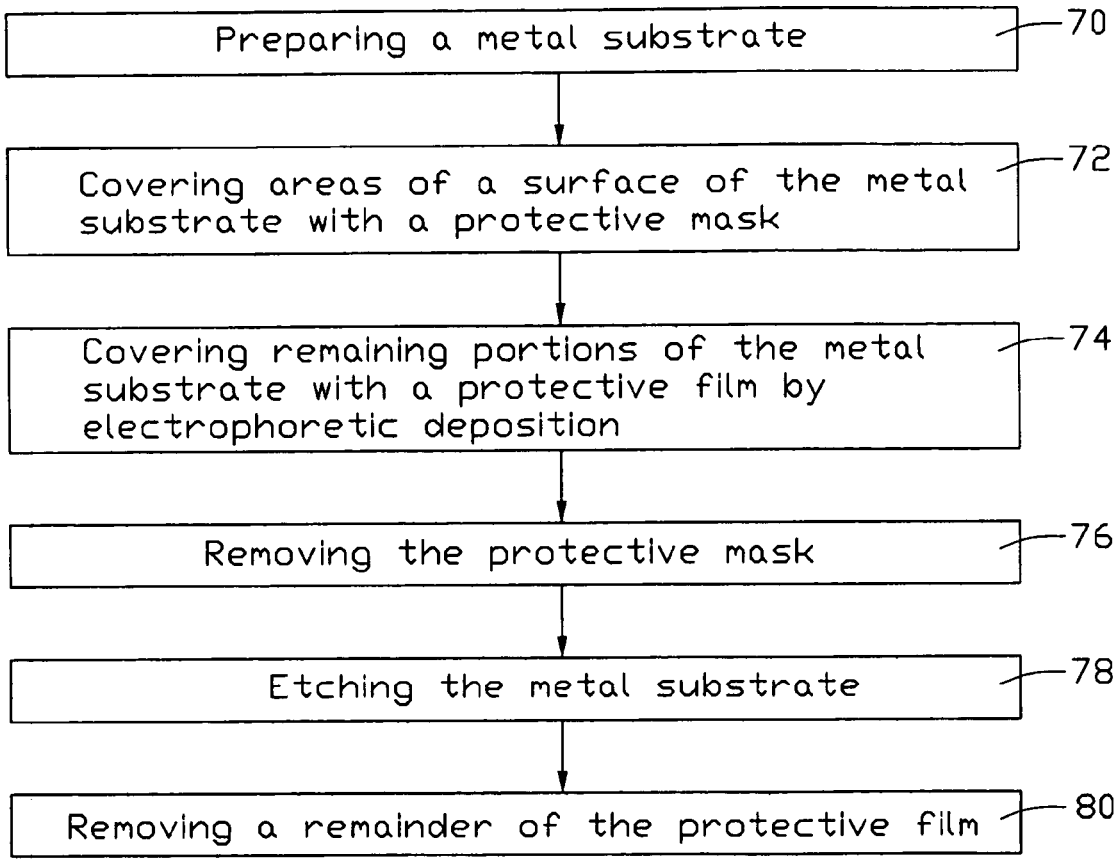
FIG. 3 is a flow chart of a second preferred method of manufacturing the metal cover of FIG. 1 according to the present invention.

Referring to FIG. 3, a second preferred method of manufacturing the metal cover 1 includes the steps of: step 70, preparing a metal substrate; step 72, covering areas of a surface of the metal substrate with a protective mask, the areas being where blind holes 3 are to be formed; step 74, covering remaining portions of the metal substrate with a protective film formed by electrophoretic deposition; step 76, removing the protective mask, thus exposing said areas of the surface of the metal substrate; step 78, etching the metal substrate at the exposed areas to form the blind holes 3; and step 80, removing the protective film from the metal substrate, thus obtaining the finished metal cover 1.

In step 74, the protective film is a coating formed by dipping the metal substrate into a cathodic electrophoretic deposition bath containing amino epoxy resin.

Further optional steps can be performed to prevent the obtained metal cover 1 from becoming oxidized. Such steps can include applying a protective top layer to the metal cover 1. Such a protective top layer can be an acrylic acid clear paint or a polyurethane clear paint. Additionally, a colored pattern can also be applied on the metal cover 1 for decoration, if desired, by spraying or painting.

Another method for preventing the metal cover 1 from becoming oxidized is to anodize the metal cover 1. To anodize the metal cover 1, the metal cover 1 is dipped into an electrolytic cell containing sulfuric acid, and direct current power is applied to the electrolytic cell. A concentration of the sulfuric acid in the electrolytic cell is in the range from 100 g/L to 200 g/L, a voltage of the direct current power applied to the electrolytic cell is between 8 V and 16 V, and a current density of the direct current power is between 100.0 $A/m^2$ and 200.0 $A/m^2$. The anodization is carried out for 30 to 60 minutes until an anodic oxide film is formed on the surface of the metal cover 1, with a thickness of the anodic oxide film being in the range from 8 μm to 20 μm. To form a colored metal cover 1, a coloring process is needed. After being anodized, the metal cover 1 is washed, dried, and then soaked in a dyeing bath containing organic dyes to color the anodic oxide film. A concentration of the organic dyes is in the range from 1 g/L to 10 g/L. The dyeing process is performed for 5 to 20 minutes. Various organic dyes can be used according to the desired color(s) of the anodized surface of the metal cover 1. For instance, if the organic dyes are composed of aluminum red GLW and aluminum violet CLW, the color of the anodized surface of the cover 1 will be red. It is understood that other anodization processes can be used in place of the above-described anodization process, and that other conventional coloring methods, such as electrolytic coloring, integral coloring, or inorganic dye coloring, can instead be used to color the anodic oxide film. Thereafter, the anodized surface of the metal cover 1 is sealed in boiling water. Such treatments as described above can result in a brilliant appearance and a high luster of the metal cover 1.

The metal cover 1 can be made from a metal substrate such as the aluminum substrate described above, or can be made from a plastic base formed by injection molding and having a metallic covering thereon.

Unlike conventional methods, the method of the present invention can form a metal cover with blind holes therein using etching of a metal substrate. The method is relatively low-cost, and suitable for either mass production or production in small quantities. Additionally, because electrophoretic deposition is used to cover a metal substrate with a protective film, the protective film can be formed on all surfaces of the metal substrate. This means that the method of the present invention is especially advantageous for manufacturing a metal cover having a three-dimensional shape. Further, if the metal cover is used as a cover for an electronic device or is assembled on the electronic device, the electronic device can thereby be made more attractive to a user.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A method of manufacturing a metal cover with blind holes therein, comprising the steps of:

preparing a metal substrate;

stamping the metal substrate into a three-dimensional shape;

covering the metal substrate, after stamping thereof, with an erosion-resistant protective film formed by electrophoretic deposition;

cutting the protective film, controlled by a predetermined pattern procedure, to form holes in the protective film on the metal substrate, thus exposing areas of the metal substrate, the cutting being performed by a cutting machine, the predetermined pattern being programmed in a computer, the cutting machine being controlled by the computer, according to the predetermined pattern;

etching the metal substrate at the exposed areas to form blind holes; and removing a remainder of the protective film on the metal substrate, thus obtaining the metal cover.

2. The method of manufacturing a metal cover with blind holes therein as claimed in claim 1, wherein the protective film is a cathodic electrophoretic coating formed by cathodic electrophoretic deposition.

3. The method of manufacturing a metal cover with blind holes therein as claimed in claim 2, wherein said cathodic electrophoretic coating is deposited by dipping the metal substrate into a cathodic electrophoretic deposition bath containing amino epoxy resin, and a concentration of the amino epoxy resin in the cathodic electrophoretic deposition bath is in the range from 10 percent to 20 percent by weight.

4. The method of manufacturing a metal cover with blind holes therein as claimed in claim 1, wherein the holes in the protective film are through holes, and are formed using a laser engraving process, the laser engraving process thereby employing a laser as the cutting machine.

5. The method of manufacturing a metal cover with blind holes therein as claimed in claim 4, wherein the predetermined pattern is used for directing a laser beam at the metal substrate according to an intended pattern of blind holes in the metal cover and for directing a laser beam at the metal substrate.

6. The method of manufacturing a metal cover with blind holes therein as claimed in claim 1, wherein the metal substrate is etched in an alkali solution of sodium hydroxide, a concentration of free sodium hydroxide in the solution is in the range from 10 g/L to 100 g/L, and an etching temperature is in the range from 30 degrees Centigrade to 90 degrees Centigrade.

7. The method of manufacturing a metal cover with blind holes therein as claimed in claim 1, wherein the metal substrate is etched in an acid solution.

8. The method of manufacturing a metal cover with blind holes therein as claimed in claim 1, further comprising the step of covering the metal cover with a protective top layer after removing the remainder of the protective film.

9. The method of manufacturing a metal cover with blind holes therein as claimed in claim 8, wherein the protective top layer is an acrylic acid clear paint or a polyurethane clear paint.

10. The method of manufacturing a metal cover with blind holes therein as claimed in claim 1, further comprising the step of applying a colored pattern on the metal cover after removing the remainder of the protective film.

11. The method of manufacturing a metal cover with blind holes therein as claimed in claim 1, further comprising the step of anodizing the metal cover after removing the remainder of the protective film.

12. The method of manufacturing a metal cover with blind holes therein as claimed in claim 11, further comprising the step of coloring the metal cover using electrolytic coloring, dye coloring or integral coloring alter anodization.

13. A method of manufacturing a metal cover with blind holes therein, comprising the steps of:

preparing a metal substrate;

stamping the metal substrate into a three-dimensional shape;

selectively covering areas of a surface of the metal substrate, after stamping thereof, with a protective mask, the areas being particularly where blind holes are to be formed;

covering remaining portions of the metal substrate with a protective film formed by electrophoretic deposition;

removing the protective mask, thus exposing said areas of the surface of the metal substrate;

etching the metal substrate at the exposed areas to form the blind holes; and washing the metal substrate using a methylbenzene solvent so as to remove a remainder of the protective film on the metal substrate, thus obtaining the metal cover.

14. The method of manufacturing a metal cover with blind holes therein as claimed in claim 13, wherein the protective film is a coating formed by dipping the metal substrate into a cathodic electrophoretic deposition bath containing amino epoxy resin.

15. A method of manufacturing a metal cover with blind holes therein, consisting essentially the steps of:

preparing a metal substrate;

stamping metal substrate into a three-dimensional shape;

dipping into the metal substrate, after stamping thereof, into a cathodic electrophoretic deposition bath containing amino epoxy resin for forming a protective film;

forming holes in the protective film on the metal substrate, thus exposing areas of the metal substrate, the forming of the holes being achieved by a laser machine burning off the protective film where the holes are formed, the laser machine being controlled by a computer according to a predetermined pattern procedure programmed therein;

etching the metal substrate at the exposed areas to form blind holes; and washing the metal substrate using a methylbenzene solvent so as to remove a remainder of the protective film on the metal substrate, thus obtaining the metal cover.

16. The method of manufacturing a metal cover with blind holes therein as claimed in claim 15, wherein a concentration of the amino epoxy resin in the cathodic electrophoretic deposition bath is in the approximate range from 10 percent to 20 percent by weight.

17. The method of manufacturing a metal cover with blind holes therein as claimed in claim 15, wherein a thickness of the protective film is about in the range from 6 μm to 10 μm, and the amino epoxy resin is EED-060 resin.

18. The method of manufacturing a metal cover with blind holes therein as claimed in claim 13, wherein a concentration of the amino epoxy resin in the cathodic electrophoretic deposition bath is about in the range from 10 percent to 20 percent by weight, the amino epoxy resin is EED-060 resin.

19. The method of manufacturing a metal cover with blind holes therein as claimed in claim 13, wherein the electrophoretic deposition is applied by a voltage of a direct current power in the approximate range of 50V to 60V and is carried out for about 40 to about 80 minutes so as to form the protective film.

20. The method of manufacturing a metal cover with blind holes therein as claimed in claim 1, wherein the electrophoretic deposition is applied by a voltage of a direct current power between about 50V and about 60V and is carried out for about 40 to about 80 minutes so as to form the protective film.

* * * * *